United States Patent [19]

Koller

[11] 4,078,295

[45] Mar. 14, 1978

[54] METHOD AND APPARATUS FOR MAKING TANKS FROM PLATES

[75] Inventor: Hans Koller, Lausen, Switzerland

[73] Assignee: Buss A.G., Basel, Switzerland

[21] Appl. No.: 763,988

[22] Filed: Jan. 31, 1977

Related U.S. Application Data

[62] Division of Ser. No. 682,376, May 17, 1976, Pat. No. 4,047,700.

[30] Foreign Application Priority Data

May 9, 1975 Switzerland ..... 6225/75

[51] Int. Cl.[2] ..... E04G 21/14

[52] U.S. Cl. ..... 29/429; 52/745

[58] Field of Search ..... 29/464, 467, 469, 429; 254/89 R, 89 H, 90; 228/1 R, 1 B, 49; 52/747, 741, 245, 745

[56] References Cited

U.S. PATENT DOCUMENTS

| | | | |
|---|---|---|---|
| 2,751,672 | 6/1956 | Reed | 29/429 |
| 2,866,261 | 12/1958 | Macku | 29/429 |
| 3,182,958 | 5/1965 | Peterzon-Arbella | 29/429 X |

FOREIGN PATENT DOCUMENTS

| | | | |
|---|---|---|---|
| 617,835 | 2/1927 | France | 29/429 |
| 833,466 | 4/1960 | United Kingdom | 29/429 |

*Primary Examiner*—Milton S. Mehr

[57] ABSTRACT

A method for constructing tanks from plates which combines lifting and rolling movements along a helical line which permits stepwise displacement of the plates.

3 Claims, 9 Drawing Figures

METHOD AND APPARATUS FOR MAKING TANKS FROM PLATES

This is a division, of application, Ser. No. 682,376, filed May 17, 1976, now U.S. Pat. No. 4,047,700.

Various methods of construction and devices are already known to form storage tanks or silos from individual sheet-metal plates or panels or from unwound wide strip according to the so-called spiral or helical method. During assembly, an upper part, which is already provided with a roof, is raised, so that further panels or wide strips can be spirally attached thereunder. The upper part has to be rotated about its centre axis during this process. It rests either on driven rollers or on spacers, between which tiltable ram-type presses can engage. Such systems are described, for example, in U.S. Pat. Nos. 2,751,672 and 2,866,261 and 3,182,958.

However, each of these known methods has its disadvantages. According to U.S. Pat. No. 2,751,672 there is required a supporting frame provided with spiral rails on which the plate, which is fastened to small roller bogies is pushed upwards. For this purpose, there are used hydraulic rams, which grip the rolling bogies in a stepwise manner. The entire system is very expensive.

U.S. Pat. No. 2,866,261 makes use of electrically driven, stationary rollers, which are placed on the lowest spiral section of the tank jacket and which serve for rolling the upper tank part upwards, so that further plates can be inserted. In the construction of large and high tanks, which are the only type where this assembly method becomes an economical proposition, the lower edges of the plates of the upper part have to be protected with screwed-on split guide rings. By way of example, the upper part of a tank having a diameter of 29m and a height of 27m weighs approximately 260,000 kg. before the end or last plate is fitted. The transport rollers have to be designed with a correspondingly large diameter of approximately 250 mm. This results in a disadvantageously large distance between the upper part and the lowest jacket section, involving a greater expenditure for the lowering operation. The guide ring parts have to be made separately for each tank diameter; their assembly and disassembly is expensive and also makes the insertion of each additional plate difficult. Furthermore, the running surfaces of the rollers must have sufficient friction; for example, they must be grooved, in order to prevent the load of the heavy upper part from being shifted. However, this also necessitates roller drives of a corresponding strength. If a number of tanks are erected in series for a tank depot of some considerable size, then a further set of electrically driven rollers has to be available for the second tank, so as to make it possible to commence the assembly of the roof on the second tank.

U.S. Pat. No. 3,182,958 describes a further method in which the upper part of the tank is raised during assembly with a fairly large number of lifting devices. These are attached to the lower tank jacket section. The movement is effected via lifting cylinders which are mounted so as to be rotatable in two directions. By this means a foot is lifted and tilted forward until it strikes against a spacing plate. The impacts thus caused can be very violent, particularly when the upper tank part is almost completed. The apparatus is very susceptible to trouble and requires a fair amount of maintenance work. Furthermore, it reacts in a sensitive manner to differences in the level of the bottom plate and the foundation disposed thereunder.

According to one aspect of the invention there is provided a method for the construction of a cylindrical jacket, for a vertical tank from plates connected to one another, wherein there is formed a bottom part having a bottom with a ring attached thereto, having an upper helically-shaped edge, as well as a cover part comprising a cover with a ring attached thereto, having a lower, correspondingly helically-shaped, edge, one part being placed upon the other, whereafter space for the insertion of additional plates is provided through the stepwise displacement of the cover part relative to the bottom part along the helical line, these plates being inserted therein, until finally the cover part is connected to the thus constructed jacket, in which the movement of the cover part along the helical line is effected by linear lifting and simultaneous rolling of the cover part, caused by its dead weight, along a surface which is inclined in the opposite sense to the inclination of the helical line.

According to another aspect of the invention there is provided apparatus for the construction of a cylindrical jacket for a vertical tank from plates connected together and comprising a bottom part, having a ring attached thereto and with an upper helically-shaped edge, and a cover part, comprising a cover with a ring attached thereto and having a lower, correspondingly helically-shaped edge, the apparatus comprising a plurality of frames fastened to the bottom part and having lifting units arranged thereon, which units act on the cover part so as to lift the cover part relative to the bottom part, freely rotatable rollers provided on the frames, which rollers can be lifted and lowered under the action of the lifting units and on which there are supported lifting slides, which slides are inserted between the cover part and the bottom part and which have a roller surface extending in the opposite sense to the inclination of the helical line.

In one embodiment the cover part is shifted along the helical line by being lifted linearly and being simultaneously rolled, as a result of its dead weight, along a surface that is inclined to the horizontal in the opposite sense to the inclination of the helical line. In the stationary condition, the upper tank part can rest on wearing plate members, a narrow air gap being provided between the upper and lower parts. In one apparatus there are provided on the frame freely rotatable rollers which can be lifted and lowered under the action of the lifting units and on which there are supported lifting slides, which are inserted between the cover part and the bottom part and which have a roller surface extending in an inclined manner that is opposed to the inclination of the spiral line.

In the frame, the rollers may be mounted in pendulum fashion outside the plate ring plane of the tank in a lever arm, which may rest on the plunger of a linearly working lifting cylinder. Advantageously, the path of the lever can be vertically adjusted in both directions by a limiting screw. The slide, which is placed on the frame and which is lifted by the feed roller, can, with its foot, take along the upper tank part and lift it so that the slide can roll forward on the feed roller for a limited part of the path under the weight load of the upper part. At the end of the roller path, the upper part expediently rests again on the wearing plate members, the slide being relieved and being retractable to its starting position by a counterweight.

The invention may be performed in various ways and one specific embodiment will now be described by way of example with reference to the accompanying drawings, in which:

FIG. 1 is a side view of a completed tank;

FIGS. 1*a* and 1*b* are side views of the lower part and the upper part of the tank before further plates are inserted;

FIG. 2 is a side view of a lifting unit;

FIGS. 2*a* and 2*b* are details of the lifting roller in its lowest and highest position;

Figure 1B:
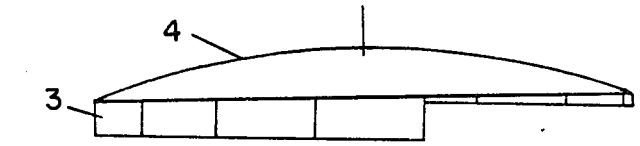
Figure 1A:
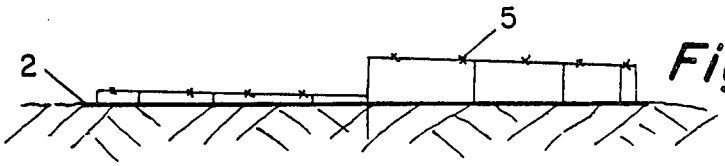
Figure 1:
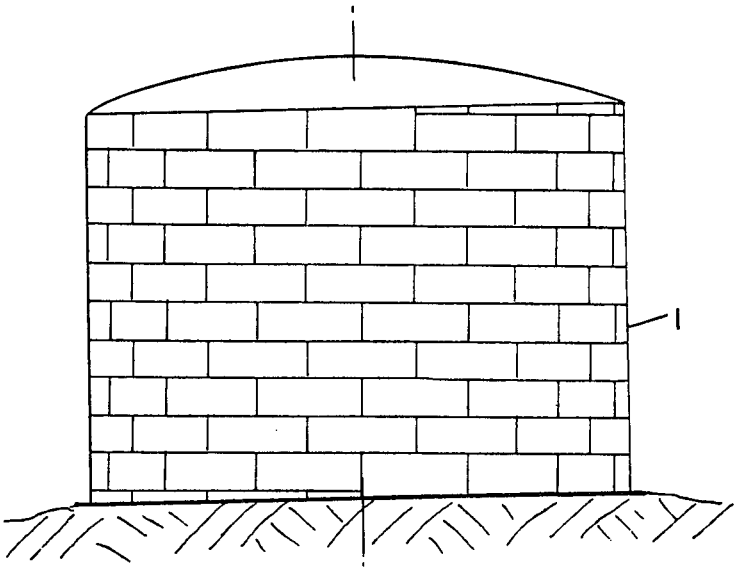

FIGS. 1, 1*a* and 1*b* show a completed tank 1 as well as the lower part and the upper part separately, as designed according to the spiral or helical method of construction.

The methods of construction known in this respect have the following mode of operation in common:

First, a number of plates, as required for the lowest ring of the tank jacket, are cut obliquely to their longitudinal direction, so as to form trapezoidal plates 2, 3 having upper and lower edges having a uniform inclination to the horizontal. The maximum plate thickness of the jacket is on the bottom and decreases in steps with increasing height, the uppermost sheet-metal ring of the jacket consisting of the thinnest plates.

The lowest plate ring 2 is welded to the tank bottom, and later a number of lifting units 5 are fitted and distributed over the circumference, (FIG. 1*a*).

Now the upper plate ring 3 is placed on the lower plate ring 2, separated by an air gap and by inserted intermediate pieces, and are joined together, this being done still at floor level.

Subsequently, the roof 4 is superimposed and is firmly connected to the upper plate ring 3, (FIG. 1*b*).

The time required for the afore-described work can be approximately half of the working time required for the construction of the tank 1 with the centre axis "A". Therefore, it is important that, when several tanks are to be erected, a second work group joins the parts 1*a* and 1*b* of the next-to-be erected tank, while a first work group erects the tank jacket of the first tank up to its full height.

The following work is also carried out at floor level:

The upper part 1*b* is raised and rotated by means of the lifting units 5 to such an extent that a further plate can be attached to the upper part, the upper circular or circumferential seam and the vertical seam then being welded through. This operation is repeated until the upper part 1 has been erected with jacket plates up to its full height and only the last mating plate has to be inserted.

To this end, the upper part is now lowered onto fitting wedges, the lifting units 5 are removed and the upper part and the lower part are firmly connected. The erection of the tank is then complete.

FIGS. 2 to 5 show equipment enabling an important improvement of the known spiral method. The new method after each lift utilises the dead weight of the upper tank part shown in FIG. 1*a* to rotate this part in an advantageous manner about the centre axis "A" and to advance it.

For this purpose, there are used lifting units 5 on which there is superimposed a lifting slide 20 whose carrying foot 29 lifts, during lifting, the upper part 1*b* with the plate ring 3 from the lower bottom plate ring 2. The lifting slide 20 then automatically rolls forward and is lowered again at the end of the advance movement, so that the upper plate ring 3 rests again on a box frame 6 of the lifting unit 5 and consequently on the bottom plate ring 2. The lifting movement is shown in the central position in FIG. 2 and in the two end or limit positions in FIGS. 2*a* and 2*b*.

Figure 5:
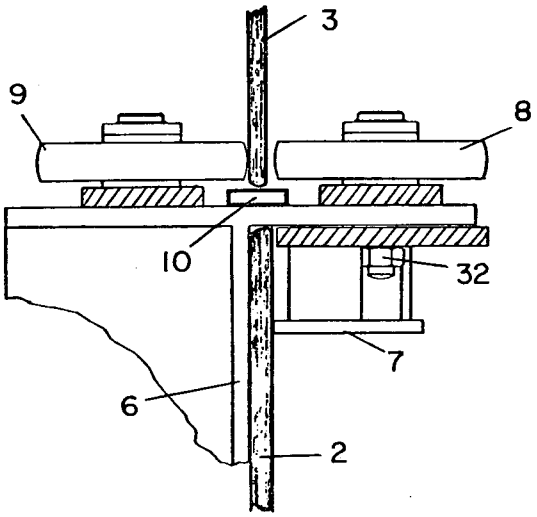
FIG. 5 is a section with a view of two guide rollers.
Figure 4:
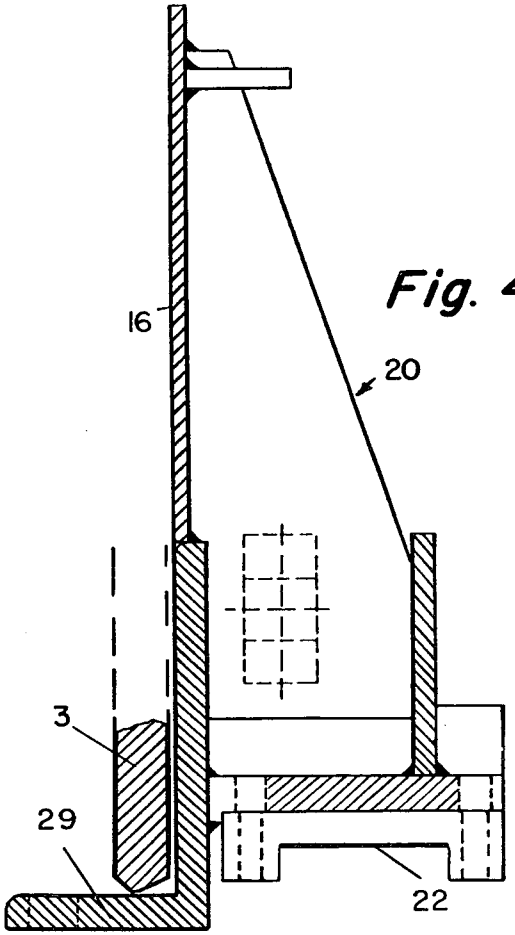
FIG. 4 is a section through a lifting slide.

The actual lifting unit, shown in FIGS. 2 to 5, comprises a solid box frame 6, which is attached to the internal side of the bottom plates 2. The frame 6 engages over the plate 2, as is shown in FIG. 5, and can be clamped against the plate by means of an eccentrically mounted disc 7. The clamping disc 7 is releasably secured to the frame 6 by a bolt and hexagonal nut 32.

Small wearing plate members 10 rest on the box frame 6, carrying the upper plate ring 3, which is guided on each lifting unit 5 between two guide roller pairs at a distance of approximately 650 mm. The internal guide rollers 9 of the guide roller pairs are fixed and the external ones 8 are adjustable about an eccentric axis.

A hydraulic lifting cylinder 11, comprising line connections 12, is mounted in the box frame 6. The lifting cylinder 11 lifts or lowers a lifting beam 14, which moves about a pivot 15. A lifting roller 17 is fastened approximately in the centre of the beam 14 so as to be freely rotatable. The lifting path 19 (FIG. 2*b*) usually is 14 mm, but it can be increased to 19 mm, and is limited by means of an adjusting screw 18.

Superimposed on the box frame 6 is a lifting slide 20 which can slide, without being loaded, in a slideway 21 on an upper part of the frame. Screwed to the lifting slide 20 is an oblique roller track 22, whose underside is hardened and ground. Furthermore, the lifting slide 20 comprises a carrying foot 29 (FIG. 4) which projects sideways and whose strength is smaller than that of the wearing plate members 10.

The entire lifting slide 20 is fastened to the box frame 6 via a toggle lever 23 having a fulcrum 24. Fastened to the toggle lever 23 is a lever arm 27 which has a length of approximately 850 mm and which carries at its end a weight disc 28. Furthermore, the toggle lever 23 may be provided with an adjustable disc cam segment 25, which co-operates with a timing switch 26. The timing switch indicates the end positions of the advance path 30 of the lifting slide 20 and can serve for controlling the power source for the lifting cylinders 11 via a contactor (not shown) with a pulse relay.

The method of use and mode of operation of the equipment is as follows:

When the assembly of the bottom part, FIG. 1*a*, and the upper part, FIG. 1*b*, placed thereon, has been completed and the parts are separated only by an air gap with inserted intermediate members, the lifting units 5 can be pushed in at the points marked in FIG. 1*a* so that they are distributed over the circumference of the plate ring 2. Now the adjustable guide rollers 8 and the clamping discs 7 are attached on the outer side and are adjusted. All that is required for this purpose is the bolt pin with the hexagonal nut 32.

On the lifting units, the lifting path 19 is limited with the aid of the adjusting screws 18. Any differences in the level of the bottom plate can thus be easily equalized.

Figure 2:
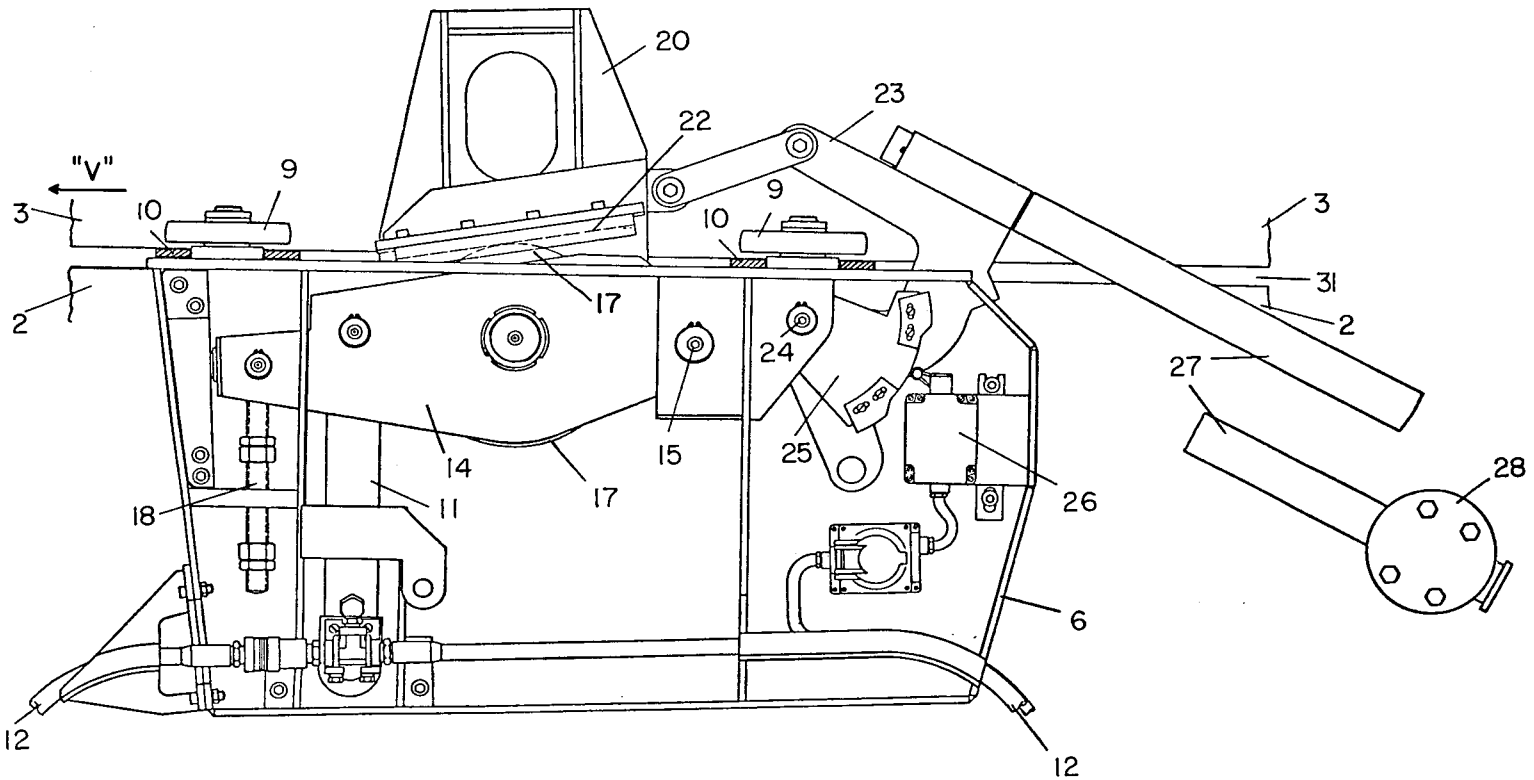
Figure 2B:
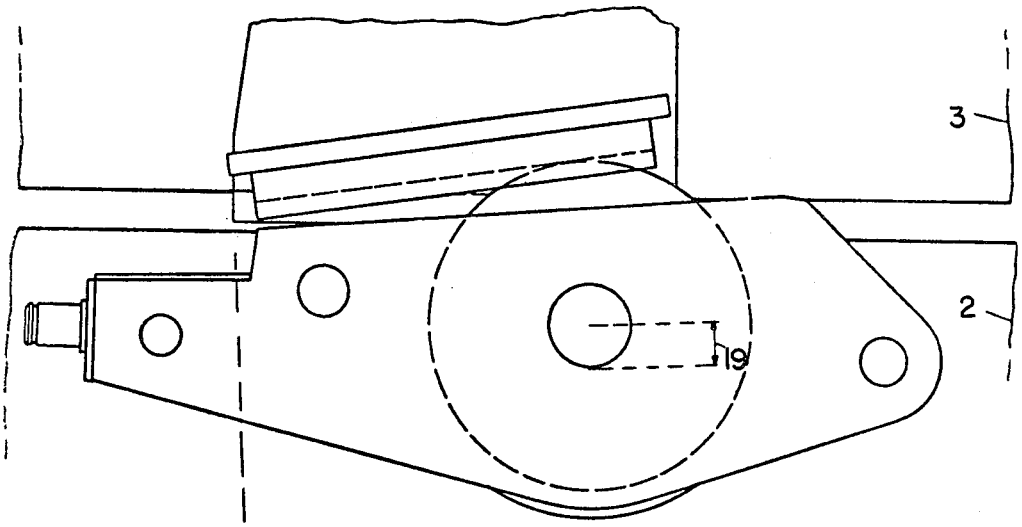
Figure 2A:
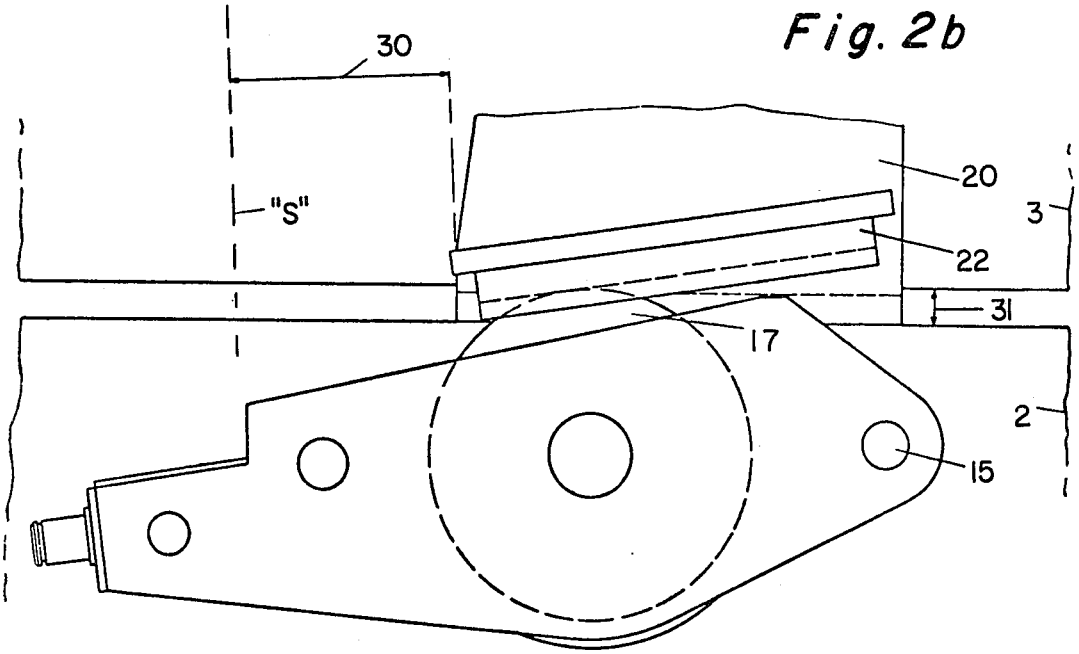
Figure 3:
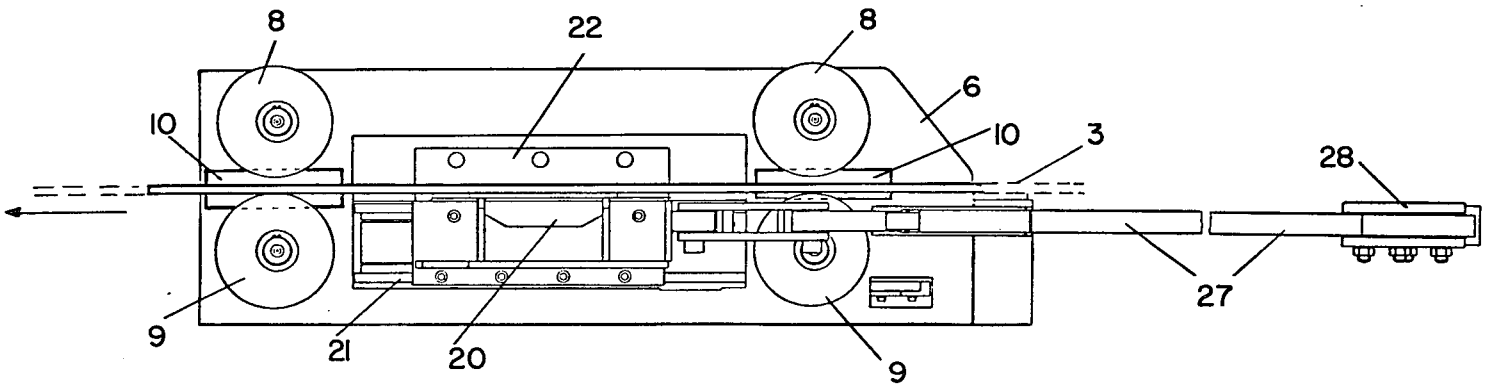
FIG. 3 is the lifting unit of FIG. 2 in a top view.

Then the hydraulic oil is fed to the lifting cylinder 11, which was in the position shown in FIG. 2*a*, from a pump (not shown) via maximum pressure hoses 12. The cylinder plunger or piston is extended by the pressure supplied, and the end of the lifting beam 14 is lifted. This also raises the lifting roller 17 and lifts the lifting slide 20 from the box frame 6. The carrying feet 29 of the lifting slides 20, which are angularly distributed over the circumference, lift the upper tank part, FIG. 1*a*, from the wearing plate members 10. The heavy weight of the upper part now causes the lifting slides 20 to roll, with their oblique roller tracks 22, along the lifting rollers 17 until the position shown in FIG. 2*b* is reached. The advance 30 achieved during this process is approximately 140 mm. The lifting cylinders 11 are now relieved from the oil pressure and the upper plate ring 3 rests once more on the wearing plates 10. The cylinders 11 of the lifting units 5 are connected to the pump by means of a ring line. The system is thus closed and comprises two feeding points. The hoses are provided with automatically closing plug couplings, and there is also installed on the pump a rapid stop device, which switches the system off in the event of a line breakage.

The advance process is completed with the lowering operation; now the lifting slide 20 is relieved and can slide in the slideway 21 back to the position shown in FIG. 2*a*. The movement is triggered by the toggle lever 23, loaded by the lever 27 with the weight 28.

The individual advances may occur in rapid succession in timed manner, for example 7 times per minute. After a sufficient number of advances, there is a short interval, in order to attach the newly inserted plate length and to weld it to the upper plate ring 3 at the vertical seam and the upper circular seam.

When the last plate has been inserted, the advance path is blocked by 2 to 4 stops. The lifting path 19 is now adjusted to the maximum height on the limiting screws 18 and the upper part is raised to enable lowering wedges to be pushed in known manner between the plate rings 2 and 3.

It is possible in a very simple manner to remove the clamping discs 7 and guide rollers 8 from the exterior of the lifting units 5, when the nuts 32 are released, and to pull out the lifting units through the air gap 31.

After adjustment of the gap with the lowering wedges, the upper part and the lower part of the tank can be finished-welded.

The method provides the advantages given hereinunder:

Sparing treatment or wear of the plate edges; a reduced power requirement because power is needed only for lifting but not for the advance and rotation of the upper part; a particularly easy and simple assembly and disassembly of the lifting appliances; only two screw connections (32) are required for each unit; there is no need to have additional devices welded or screwed to the plates. A trouble-free and reliable use, since the lifting cylinders work only linearly and are not stressed by rotation. It is not necessary for the lifting appliances to be superimposed with the first plate ring 3 on the lower part, FIG. 1*a*, when the upper part, FIG. 1*b*, is mounted; they may be lightly pushed in later.

I claim:

1. A method for the construction of a cylindrical jacket for a vertical tank from plates connected to one another comprising:

forming a bottom part of said jacket in a portion of a ring of said plates connected to one another;

building up said bottom ring with an upper helically-shaped edge of said plates connected to one another to thereby provide a top part of the sides of said jacket;

forming a cover part comprising a cover with a ring of plates attached thereto, said cover being formed with a lower helically shaped edge part, said cover part being placed upon the bottom part such that space for the insertion of additional plates is provided;

attaching plates to the side plates at the sides of the jacket while providing a stepwise displacement of the cover part relative to the bottom part with said plates attached along the helical line following the edge of the bottom part and attaching the plates until the cover part is finally connected to the jacket, lifting the cover part along the helical line by a linear lifting movement and a simultaneous rolling movement of the cover part which results from the dead weight of the cover part moving along the surface which is inclined upwardly and in the opposite sense to the inclination of the helical edge of the bottom part; and completing the attachment of the plates about the cover part so displaced and lifted to complete the construction.

2. A method as claimed in claim 1, wherein said lifting and rolling movement of the cover part takes place several times in a timed sequence until a sufficient advance has been achieved to an extent which permits an additional plate to be inserted.

3. A method as claimed in claim 1, in which after each advance the cover part is placed on the bottom part on spacers which are placed therebetween.

* * * * *